US007249743B1

(12) United States Patent
Stearns

(10) Patent No.: US 7,249,743 B1
(45) Date of Patent: Jul. 31, 2007

(54) SELF-LEVELING SIGN HANGER

(76) Inventor: Donna Stearns, 5 Amelia Way, Medway, MA (US) 02053

( * ) Notice: Subject to any disclaimer, the term of this patent is extended or adjusted under 35 U.S.C. 154(b) by 359 days.

(21) Appl. No.: 08/596,081

(22) Filed: Feb. 6, 1996

(51) Int. Cl.
*A47H 1/10* (2006.01)

(52) U.S. Cl. ..... 248/329; 40/601; 248/332; 254/46

(58) Field of Classification Search ..... 248/332, 248/329, 328, 327, 317; 254/46; 40/601
See application file for complete search history.

(56) References Cited

U.S. PATENT DOCUMENTS 4,434,570 A 3/1984 Roos ..... 40/617
4,872,632 A 10/1989 Johnson ..... 248/332
5,381,991 A 1/1995 Stocker ..... 248/206.5
5,409,191 A 4/1995 Wenmaekers ..... 248/317
5,438,780 A 8/1995 Winner ..... 40/514
5,480,116 A * 1/1996 Callas ..... 248/317 X
5,529,274 A 6/1996 Anderson et al. ..... 248/329

* cited by examiner

*Primary Examiner*—Ramon O Ramirez
(74) *Attorney, Agent, or Firm*—Breiner & Breiner, LLC

(57) ABSTRACT

A device for raising and lowering a sign suspended from a ceiling, comprising a reversible motor adapted to be mounted to the ceiling at a first location; a sign carrier for holding a sign to be suspended from the ceiling; and a line running from the motor, to the sign carrier, and back to the ceiling at a second location spaced from the first location. The line is mounted to the ceiling at the second location. The motor is controlled to turn in opposite directions to raise and lower the sign carrier in relation to the ceiling, to allow a sign held by the sign carrier to be positioned relative to the ceiling.

18 Claims, 2 Drawing Sheets

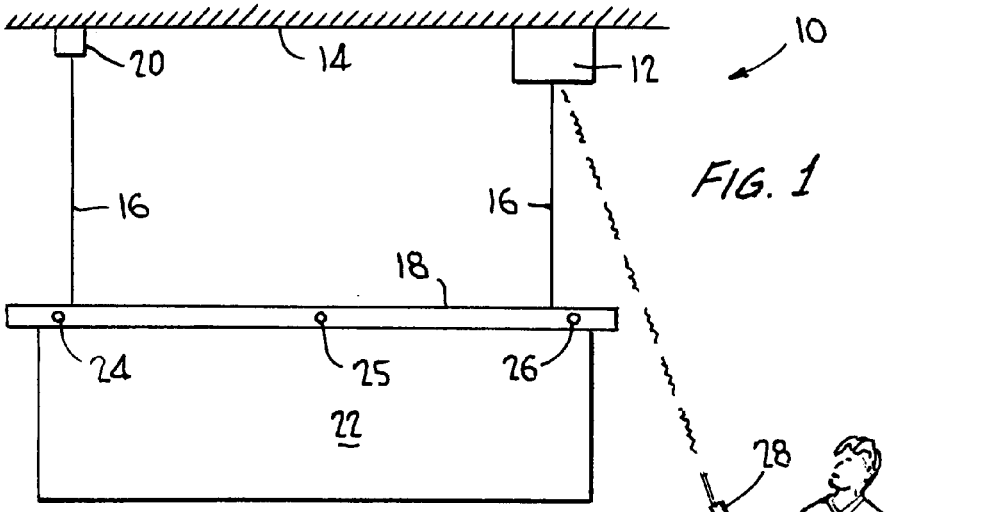
FIG. 1
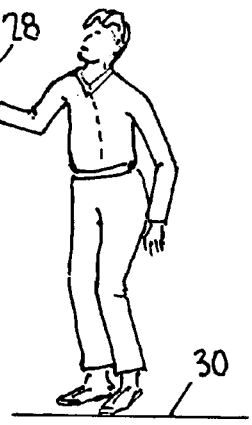
FIG. 2A
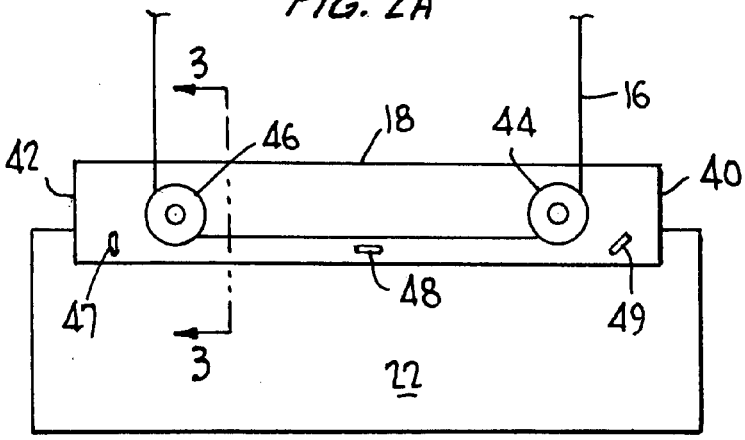
FIG. 2B
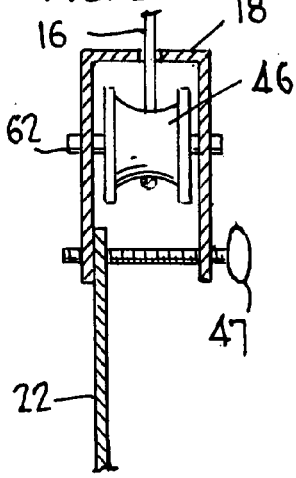
FIG. 3
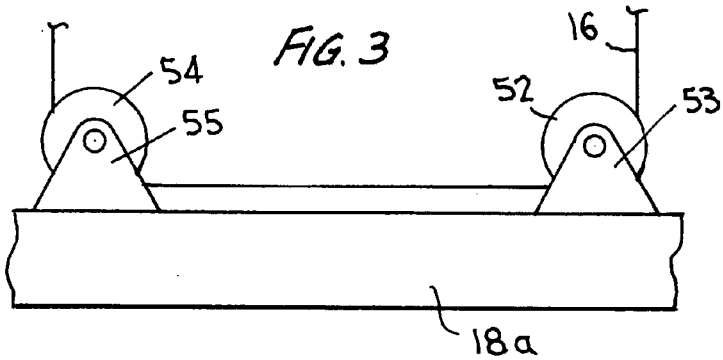

SELF-LEVELING SIGN HANGER

FIELD OF INVENTION

This invention relates to a device for hanging signs from the ceiling. The device is particularly useful in retail stores with high ceilings.

BACKGROUND OF INVENTION

Hanging signs from ceilings in retail stores has become more prevalent and more problematic with the increase in the number of warehouse-type stores with high, exposed ceilings. In more traditional store construction, with suspended ceilings, signs can simply be hung from the ceiling by climbing a step ladder, or using relatively short poles, to lift the sign hanger to the ceiling. Signs hung in this manner may use a sign hanger that grips ceiling metallic members magnetically.

In warehouse stores, however, the ceilings may be dozens of feet high, making access very difficult. Signs in these stores are typically hung from the ceiling members using wire or other flexible line that is secured to the ceiling by a person on a tall ladder or a mechanized lift. Such sign installation services are typically outsourced to a contractor who works when the store is closed. This service can cost hundreds of dollars per sign. As a result, stores often do not hang signs in situations in which it would be helpful to do so, for example to promote sales. Also, store owners must spend quite a bit of money to hang the signs that are needed in the store. These signs are usually permanent signs because of the cost and difficulty in changing them.

SUMMARY OF THE INVENTION

It is therefore an object of this invention to provide a device that allows signs to be easily suspended from store ceilings by untrained store personnel without the need for ladders, lifts, or hanger installation poles.

It is a further object of this invention to provide such a device that allows the sign to be suspended any desired distance from the ceiling.

It is a further object of this invention to provide such a device that is self-leveling.

This invention results from the realization that a self-leveling, automatic sign hanger can be accomplished with a line winding device that is coupled to the ceiling, from which a flexible line is run down to and through a sign carrier, and back up and fixed to the ceiling at a point spaced from the line winding device. The line winding device is then manipulated either electrically or manually to raise and lower the sign carrier. The sign carrier can be lowered closer to the floor to allow the store personnel to install a sign therein, and then raised back up to the desired height. The line is allowed to run freely through the sign carrier so that the sign carrier is self-leveling, regardless of its distance from the ceiling.

This invention features a device for suspending a sign from the ceiling. The device in one embodiment includes a line winding device adapted to be coupled to the ceiling, a sign carrier for holding a sign, a line securing device adapted to be coupled to the ceiling at a location spaced from the line winding device to hold an end of the line at that location, and a flexible line running from the winding device, to the carrier, and back to the line securing device. The line winding device can be manipulated to take up and let out the line to raise and lower the sign carried by the sign carrier in relation to the ceiling. This allows a sign held by the sign carrier to be positioned where desired relative to the ceiling.

The sign carrier is designed to allow the line to run freely through it so that the sign carrier is self-leveling regardless of its distance from the ceiling. This may be accomplished by mounting two or more grooved wheels to or within the sign carrier, and running the line underneath the wheels. To maintain the line hanging vertically regardless of the location of the sign carrier, the outer two wheels are preferably spaced apart the same distance as the spacing between the line winding device and the line securing device. If those outer two wheels are also equally spaced from the ends of the sign carrier, the whole system is in balance so that the sign carrier is always horizontal.

The line winding device may be manually or electrically manipulated. Preferably, the line winding device is a reversible electric motor that drives a spool for taking up and letting out line. This motor is remotely operable either by a hard-wired switch or a wireless remote control.

In another embodiment, this invention features a device for raising and lowering a sign suspended from a ceiling using a reversible motor adapted to be mounted to the ceiling at a first location, a sign carrier for holding a sign to be suspended from the ceiling, a line running from the motor, to the sign carrier, and back to the ceiling at a second location spaced from the first location, and a fixing means adapted to mount the line to the ceiling at the second location. There is a motor control means adapted to control the motor to turn in opposite directions to raise and lower the sign carrier in relation to the ceiling, to allow a sign held by the sign carrier to be positioned relative to the ceiling.

The sign carrier may include an elongated horizontal clamping member, and sign fasteners for holding the sign in the clamping member. The sign carrier preferably includes at least two levelers coupled to the clamping member and carrying the line to maintain the clamping member horizontal as it is raised and lowered. The levelers may be rollers such as grooved wheels, in which the line is carried in the wheel grooves. Preferably, there are two levelers, either within or coupled to the sign clamping member which are equidistant from the clamping member ends and spaced apart the same distance as the spacing between the reversible motor and the line fixing means, so that the line hangs down essentially vertically from the motor to one leveler, and from the fixing means to the other leveler.

The motor control means may include a remote control unit for operating the motor. The remote control unit may be a hard wired unit that is within reach of the floor, or may be a wireless remote control unit.

Also featured in this invention is a sign suspension system for supporting signs from the ceiling of a building, including a power-actuated drum system secured to the ceiling with a suspension cord carried by the drum, in which one end of the suspension cord is secured to the ceiling at a point remote from the drum. There is a control circuit for the drum system and a remote controller for operating the control circuit. There is a horizontal sign carrier having spaced sheaves thereon with a cord passing between the sheaves whereby the cord serves to suspend the sign carrier. There are attachment means for securing a sign to the carrier.

BRIEF DESCRIPTION OF THE DRAWINGS

Other objects, features and advantages will occur to those skilled in the art from the following description of preferred embodiments, and the accompanying drawings, in which:

FIG. 1 is a schematic view of a self-leveling sign hanging device according to this invention;

FIG. 2A is a more detailed schematic view of one embodiment of a sign carrier for the device invention;

FIG. 2B is a cross sectional view taken along line 3-3 of FIG. 2A, detailing a preferred construction of the sign carrier for this invention;

FIG. 3 is a view similar to that of FIG. 2A for another embodiment of the sign carrier;

DESCRIPTION OF THE PREFERRED EMBODIMENTS

Figure 4:
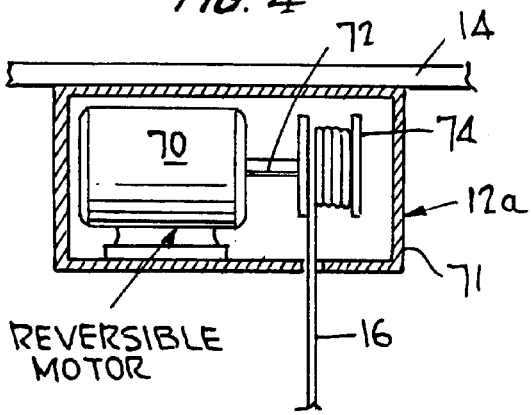
FIG. 4 is a cross sectional, schematic view of a preferred embodiment of the line winding device for this invention.

There is shown in schematic form in FIG. 1 self-leveling sign hanging device 10 according to this invention. Device 10 includes line winding device 12 which is adapted to be coupled to ceiling 14. Horizontal line carrier 18 is adapted to hold sign 22 with sign fasteners 24 through 26. Flexible line 16, which may be nylon monofilament line, runs from winding device 12, to sign carrier 18, and back up to line securing device 20 which is also adapted to be coupled to ceiling 14, but at a location spaced from winding device 12. Sign carrier 18 is designed to allow line 16 to slide therethrough so that sign carrier 18 remains horizontal as winding device 12 is manipulated to take up and let out line to raise and lower sign 22 in relation to ceiling 14/floor 30.

In the preferred embodiment, line winding device 12 is a accomplished with a reversible motor that is remotely controlled through wireless remote control 28, for example one operated by infrared or radio waves. Alternatively, such a reversible motor could be controlled by a switch hard wired to the motor and accessible to store personnel, preferably within reach of floor 30.

The preferred manner of accomplishing sign carrier 18 is shown in FIGS. 2A and 2B. Grooved wheel rollers 44 and 46 are carried inside of U-shaped horizontal clamping member 18. Line 16 enters member 18 through holes, not shown, and engages with and under the grooves in rollers 46 that are mounted to member 18 by pins 62. Sign 22 is held to clamping member 18 with fasteners 47 through 49, which may be accomplished with wing screws that pass through threaded holes in member 18, and holes in sign 22. Other equivalent sign fastening means are also contemplated. The actual means used depends to some extent on the design of the sign carrier as well as the size and weight of the sign. For example, for lighter signs, the wing nut sign fasteners could just be tightened down and engage with the sign within clamping member 18. All that is necessary is for the sign to be held firmly within the sign carrier, and hanging therefrom, in a fashion that is relatively easy for store personnel to accomplish.

An alternative manner of accomplishing the sign carrier and the levelers coupled to the sign carrier for carrying a line, is shown in FIG. 3. Leveler grooved-wheels (sheaves) 52 and 54 are rotatably carried within support members 53 and 55, respectively, that are mounted to the top of clamping member 18*a*. Locating the leveler wheels within the sign carrier as accomplished in the embodiment of FIGS. 2A and 2B is simply an aesthetic choice. The levelers need not be wheels, or grooved wheels, as long as they accomplish the hanging of the sign carrier, and allow the line carrier to slide on the line.

Levelers 44 and 46 are spaced equidistantly from ends 40 and 42, respectively, of sign carrier 18, so that sign carrier 18 is balanced on line 16 and remains horizontal. As sign carrier 18 moves up and down in relation to ceiling 14, it remains horizontal through a combination of this roller placement, and the spacing apart of the rollers a distance equal to the distance between line winding device 12 and line securing device 20, FIG. 1, so that the line hangs straight down from each of those members to the sign carrier 18, as shown in FIG. 1.

Line 16 is preferably automatically wound and unwound from a line carrying drum by a reversible motor as shown schematically in FIG. 4. Line winding device 12*a* includes motor 70 which drives shaft 72 to turn line winding drum 74 in opposite directions to wind and unwind line 16 from drum 74 and move sign carrier 18 in relation to ceiling 14. Motor 70 is carried in case 71 that can be coupled to ceiling 14 in any convenient manner. When the sign needs to be changed, line 16 is unwound to drop carrier 18 close enough to floor 30 so that a person can remove and replace the sign. The motor is then enabled to turn in the other direction to wind line 16 on drum 74, and raise carrier 18 to a desired height, at which point the motor is stopped.

Figure 5C:
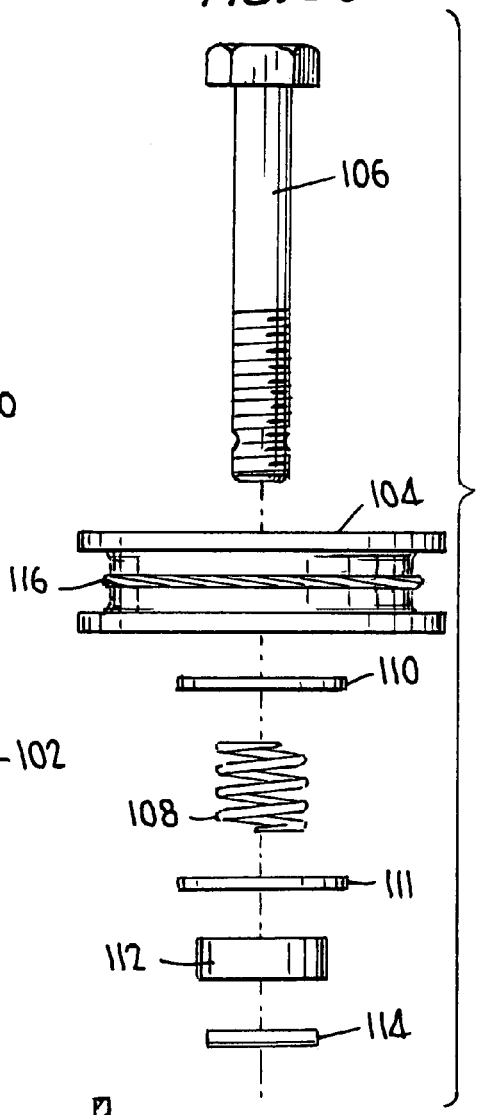
FIG. 5C is an exploded view of the line winding device of FIGS. 5A and 5B.
Figure 5A:
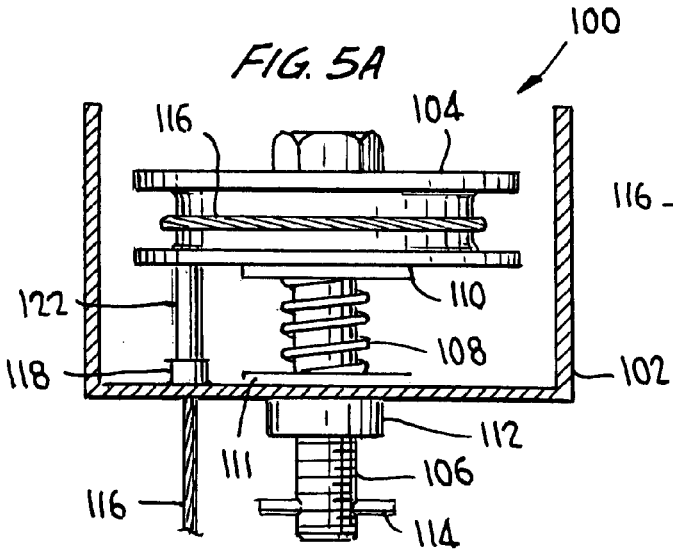
FIGS. 5A and 5B are cross sectional end and side views, respectively, of an alternative, manual embodiment of a line winding device for this invention.
Figure 5B:
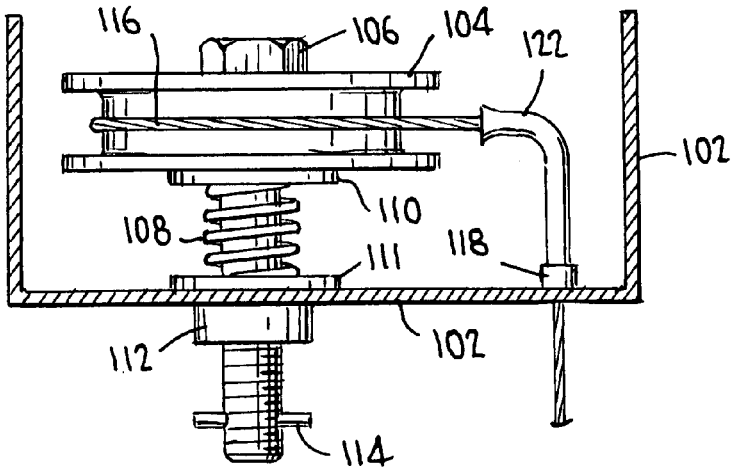

A manually-windable line winding device according to this invention is shown in FIGS. 5A through 5C. Device 100 includes housing 102 which holds grooved wheel 104 that rotates about bolt 106 that passes through the center of wheel 104 and out of housing 102 and held in place with collar 112. Spring 108 is held in compression between washers 110 and 111 to hold wheel 104 above the floor of housing 102. Monofilament line 116 is wound within the central groove in wheel 104, and passes out and through steel tubing 122 held in collar 118 that provides a guide through the floor of housing 102.

Clevis pin 114 is inserted through the lower portion of bolt 106 to allow the bolt, and thus wheel 104, to be turned from below by means of a pole having a recess or cutout in its end just slightly larger in diameter than the diameter of pin 114. The pole can be placed over pin 114 and rotated to rotate bolt 106 in order to take up or let out line from wheel 104.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A device for raising and lowering a sign suspended from a ceiling, comprising:

a reversible motor adapted to be mounted to the ceiling at a first location;

a sign carrier for holding a sign to be suspended from the ceiling;

a line running from said motor, to said sign carrier, and back to the ceiling at a second location spaced from said first location;

fixing means adapted to mount said line to the ceiling at said second location; and motor control means adapted to control said motor to turn in opposite directions to take in and let out said line, to raise and lower said sign carrier in relation to the ceiling, to allow a sign held by said sign carrier to be positioned relative to the ceiling.

2. The device of claim 1 in which said sign carrier includes an elongated horizontal clamping member.

3. The device of claim 2 in which said sign carrier further includes sign fasteners, for holding the sign in said clamping member.

4. The device of claim 2 in which said sign carrier further includes at least two levelers, coupled to said clamping member, carrying said line, and adapted to maintain said clamping member horizontal as it is raised and lowered.

5. The device of claim 4 in which said levelers are rollers.

6. The device of claim 5 in which said rollers are grooved wheels, in which said line is carried in the wheel grooves.

7. The device of claim 4 in which there are two levelers, and said levelers are equidistant from the clamping member ends, and spaced apart a first distance.

8. The device of claim 7 in which said first location and said second location are spaced apart essentially said first distance, so that said line hangs down essentially vertically from said motor to one said leveler, and from said fixing means to another said leveler.

9. The device of claim 4 in which said levelers are located within said sign carrier.

10. The device of claim 1 in which said motor control means includes a remote control unit for operating said motor.

11. The device of claim 10 in which said remote control unit is a wireless remote control.

12. The device of claim 10 in which said remote control unit is within reach of the floor.

13. A device for suspending a sign from a ceiling, comprising:

a line;

a line winding device adapted to be coupled to the ceiling;

means for manipulating said line winding device to take up and let out said line;

a sign carrier for holding a sign, in which said line is movably coupled to said sign carrier; and a line securing device adapted to be coupled to the ceiling at a location spaced from said line winding device to hold an end of the line at said location;

wherein said sign carrier is raised and lowered in relation to the ceiling by manipulation of said line winding device, to take in and let out said line, to allow a sign held by said sign carrier to be positioned relative to the ceiling.

14. A sign suspension system for supporting signs from the ceiling of a building, said sign suspension system including:

a power-actuated drum system secured to said ceiling, suspension cord being carried by said drum, one end of said suspension cord being secured to said ceiling at a point remote from said drum;

a control circuit for said drum system, a remote controller for operating said control circuit;

a horizontal sign carrier, said sign carrier having spaced sheaves thereon, and said cord passing between said sheaves, whereby said cord serves to suspend said sign carrier; and attachment means for securing a sign to said carrier.

15. A sign suspension system for suspending display signs from the ceiling, said system including:

a sign carrier, said carrier including at least one horizontal rail and two sheaves;

a motor control unit including a reversible motor and a drum operated by said motor, said motor control unit being mounted at the ceiling;

a cord-attaching member secured to the ceiling;

a cord running from said cord-attaching member through said sheaves and to said drum, said cord supporting said sign carrier; and a remote control unit for operating said motor, said remote control unit having forward, reverse, and off positions;

whereby said sign carrier, carrying a sign, can be raised and lowered to and from said ceiling.

16. A sign suspension system as set forth in claim 15 in which said sheaves are spaced equidistantly from their respective ends of said horizontal rail.

17. A sign suspension system as set forth in claim 15 in which the distance between said sheaves and the distance between said cord-attaching unit and said drum are substantially the same, whereby said sign carrier is held in balanced suspension.

18. A sign suspension system as set forth in claim 15 in which said remote control unit is radio-operated.

* * * * *